US005729939A

United States Patent [19]

Di Benedetto

[11] Patent Number: 5,729,939

[45] Date of Patent: Mar. 24, 1998

[54] STEEL ANCHOR BRACKET FOR SURFACE MOUNT ON A CONCRETE WALL

[76] Inventor: Frank Di Benedetto, 91 Rand St., Stoney Creek, Ontario, Canada, L8J 1A5

[21] Appl. No.: 666,594

[22] Filed: Jun. 18, 1996

[51] Int. Cl.[6] ..... E02D 27/00

[52] U.S. Cl. ..... 52/293.3; 52/295; 52/699; 52/374

[58] Field of Search ..... 52/293.3, 295, 52/92.1, 92.2, 720.1, 739.1, 699, 374, 293; 428/598, 596, 603; 29/897, 897.3, 897.34

[56] References Cited

U.S. PATENT DOCUMENTS

| | | | |
|---|---|---|---|
| 2,903,879 | 9/1959 | Williams | 52/293.3 X |
| 3,574,984 | 4/1971 | Chap . | |
| 3,925,952 | 12/1975 | Hagel et al. | 52/293.3 X |
| 4,021,984 | 5/1977 | Honegger | 52/699 X |
| 4,524,555 | 6/1985 | Pantalone | 52/739.1 |
| 4,825,529 | 5/1989 | Sawada et al. | 29/897.3 |
| 4,964,256 | 10/1990 | McCracken | 52/739.1 X |
| 5,481,844 | 1/1996 | Kajita | 52/92.2 X |

*Primary Examiner*—Lanna Mai
*Attorney, Agent, or Firm*—Edward H. Oldham

[57] ABSTRACT

A metal anchor bracket which is embedded into the surface of a semi-solid concrete wall before the concrete has set. The bracket has a reference surface which when flush with the surface of the concrete wall produces a vertical surface which is perpendicular to the surface of the wall. The vertically extending surface provides an anchor for steel super structural members which are attached thereto. A second vertically extending leg is immersed into the soft concrete to anchor the bracket in the concrete.

9 Claims, 1 Drawing Sheet

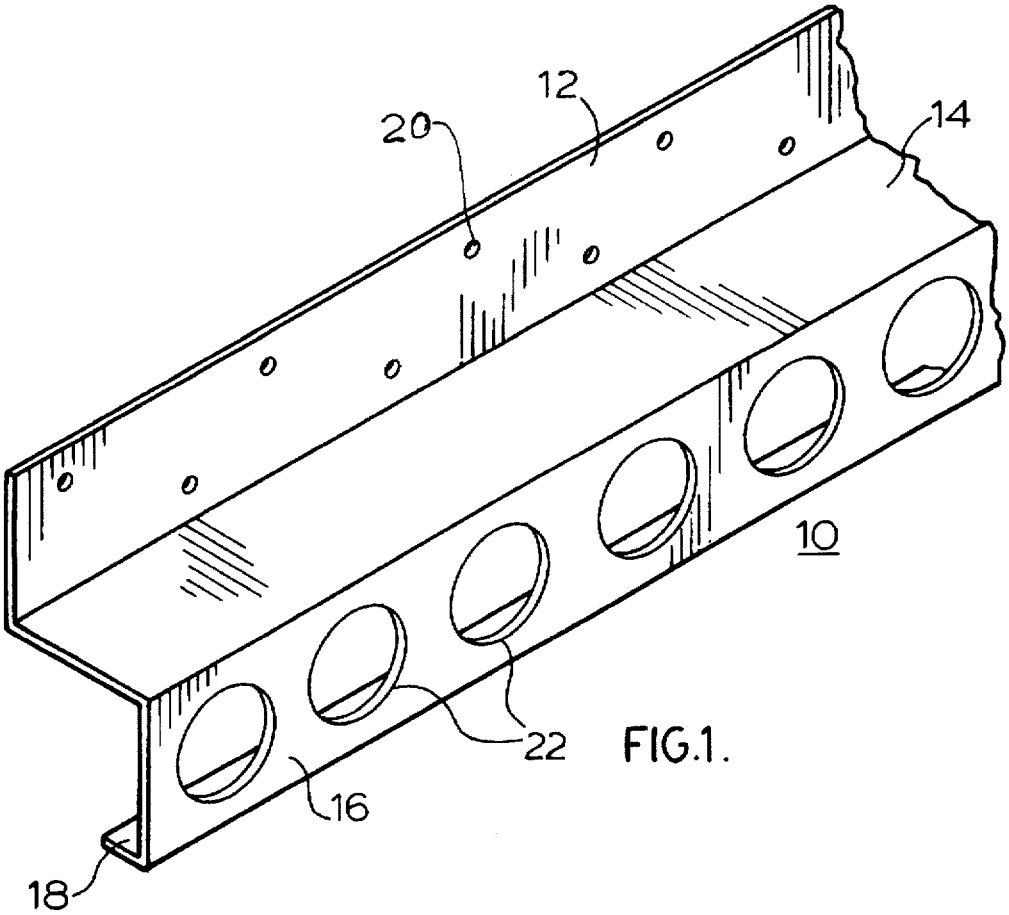
FIG.1.
FIG.2.
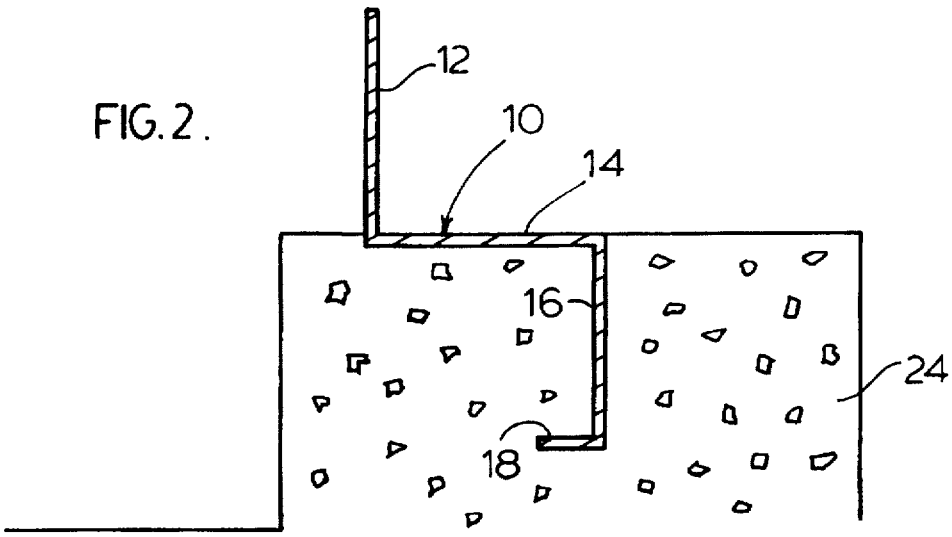

STEEL ANCHOR BRACKET FOR SURFACE MOUNT ON A CONCRETE WALL

This invention relates to an angle bracket insert which is inserted in the top surface of a concrete wall while the concrete is still in a semi-liquid state. The bracket insert may be conveniently inserted into the concrete medium to a predetermined depth because of its shape. The shape of the bracket also enables the installation crew to quickly install the bracket in the setting concrete and be confident that the upstanding leg of the bracket is perpendicular to the top surface of the wall. The bracket may be accurately placed and moved laterally to the desired predetermined location. Once the concrete wall has set, the bracket cannot be removed without destruction of either the bracket or the top surface of the wall. The bracket insert is primarily intended to be used in the construction of buildings where steel joists and studs are used for floor and wall construction.

BACKGROUND OF THE INVENTION

In the construction of buildings in which steel super structural members are utilized for building construction, it is customary to secure the steel superstructure members to some form of a plate (angle plate) which is bolted to the concrete wall on which the structural steel members are placed. A steel header is usually fastened to the angle plate and the ends of the structural members, i.e. floor joists, to the steel header.

The entire construction depends on the accurate placement of anchor bolts sunk into the semi-solid concrete which ultimately hold the anchor plate firmly to the concrete. The anchor plates are provided with predrilled holes which are supposed to fit over the exposed bolts projecting from the surface of the concrete. Nuts are supplied for threading onto the threaded ends to hold the angle plate firmly against the concrete surface.

In most instances, the placement of the anchor bolts is done by a different work crew, than the crew installing the steel superstructural members such as steel floor joists. Because each bolt must be individually placed, the chances of placement error is great . . . the bolts may not be perpendicular to top surface of the wall and each bolt must be carefully placed in order to fit into the predrilled holes of the angle bracket. If the bolts are correctly placed in the concrete, sometimes the placement crew splash concrete onto the threaded portion of the bolts making the operation of screwing a nut onto the threads a virtual impossibility. Any exposed bolt which is not correctly placed merely serves to complicate the attachment of the angle plates. Workers may cut holes in the angle members or in some instances cut off the protruding but misplaced bolt.

If the foundation and the anchor bolts is allowed to stand idle for any length of time, the bolts will no doubt rust, leading to another difficulty in the assembly of the anchor plate to the top surface of the wall.

This invention overcomes the shortcomings of the prior art by the complete elimination of anchor bolts from the top surface of the foundation wall.

SUMMARY OF THE INVENTION

This invention comprises a steel plate having three right angle bends to produce an elongated bracket having four flat surfaces each orthogonal to the adjacent surface such that two pairs of parallel surfaces are produced and each pair of parallel surfaces is orthogonal to the other pair.

The surfaces are made so that a first surface of the bracket will lie on the top horizontal surface of the recently poured concrete wall while one adjacent leg protrudes vertically above the wall surface to engage the structural steel members to be attached to the bracket. The other adjacent vertical leg is embedded in the soft concrete. This leg is provided with apertures to assist in placement in the recently poured concrete as well as positive locking in the cured concrete. An upturned flange is provided on the opposite end of the apertured leg to provide additional stabilization and locking in the concrete wall.

RELEVANT PRIOR ART

U.S. Pat. No. 3,574,984 Apr. 13, 1971

BRIEF DESCRIPTION OF THE DRAWINGS

FIG. 1 is a perspective view of the bracket insert of this invention;

FIG. 2 is a sectional view showing the bracket mounted in the concrete wall of a building.

DESCRIPTION OF THE PREFERRED EMBODIMENT

Referring to FIG. 1, a length of the bracket insert 10 is shown in perspective. The bracket insert 10 may be manufactured in any length but it will be found that a standard length of 8–10 feet will be a standard and shorter lengths may be pre-manufactured or cropped from the longer lengths. The bracket insert 10 has four legs 12, 14, 16 and 18. The four leg surfaces are all orthogonal to adjacent surfaces.

The reference surface 14 is embedded flush with the top surface of the recently poured concrete wall. Leg 12 of bracket 10 thus protrudes above the top surface of the concrete wall to be used as an anchor for the steel members to be attached thereto. Holes such as the one shown at 20 are provided at equally spaced intervals for attachment of structural members thereto. The downwardly extending leg 16 is made to be inserted into the soft concrete of a recently poured wall. Leg 16 has a series of apertures 22 therein which enable the leg 16 to be laterally shifted in the soft concrete to allow accurate placement of the bracket before the concrete is cured. An overturned flange 18 is provided at the end of leg 16 to provide stiffness to leg 16 and additional stabilization of the bracket 10 in the soft concrete prior to setting.

FIG. 2 is a cross-sectional view showing the bracket 10 mounted in a concrete wall 24. The bracket 10 is embedded in wall 24 until the top surface of leg 14 is flush with the top surface of the concrete wall. The bracket 10 is then moved laterally until the desired lateral position is achieved. Apertures 22 assist in allowing leg 16 to move laterally through any aggregate. Flange 18 will probably rest on some aggregate because of the manner in which bracket 10 is inserted into the soft concrete. This helps to prevent distortion of bracket insert 10.

An eight foot length of bracket 10 may be conveniently inserted into the soft concrete to produce an upstanding vertical leg 12 to which structural members such as studs, joists or siding may be attached.

When compared to the prior art methods of producing anchor members in the top of a concrete wall, this device produces superior advantages. The bracket 10 is placed in the uncured concrete until the top surface of leg 14 is flush with the top surface of the concrete wall. If the top surface of the concrete has been screeded, it is usually a simple matter to sink leg 16 into the soft concrete until the top surface of leg 14 lies flush with the screeded surface of the wall. It is a simple matter to determine that surface 14 is horizontal, and once surface 14 is horizontal, leg 12 must be vertical. Because of the construction of bracket insert 10, it is extremely rigid in the longitudinal axis and once the two ends have been accurately located in the concrete wall, it will be found that the bracket insert 10 will be straight and true without curving in the longitudinal axis.

This device is not subject to moving once set in the concrete wall, and it may be accurately placed by locating both ends of the bracket with the knowledge that the rest of the bracket is in line with the two ends. Inserts 10 may be placed end to end to provide a continuous vertical leg 12.

The insert itself may be made out of 18 gage steel which has been coated with protective coating such as by galvanizing to resist corrosion. This gauge has been found to be satisfactory for most applications.

When compared to prior art methods of providing anchors in top surfaces of concrete walls, the bracket of this invention is superior. No misplaced or mis-aligned bolts in the cured concrete must be dealt with, and no concrete covered threads are to be encountered. The building process is expedited as a result.

Though the applicant's device is structurally simple, it is a robust structure, well designed to accomplish the function of easy insertion and adjustment into the concrete wall and yet provide an accurate and sturdy anchor once the concrete has set.

I claim:

1. A bracket insert for placement in a recently poured concrete structure comprising an elongated sheet metal member having stepped cross-section formed by bending the insert to fold the member along parallel lines extending along the length of the insert, a first step of said member section forming an upstanding sheet metal flange above the concrete surface in which the insert is inserted, a second leg of said section being orthogonal to said first leg and forming a second flat surface, said second surface being flush with the surface of said concrete when said insert is inserted into its final position in said concrete surface, a third leg of said section being orthogonal to said second leg and extending in a direction opposite to said first leg, said third leg forming a third flat surface substantially parallel to said first flat surface, and a fourth leg of said section being in the form of a lip formed orthogonally to said third surface, said insert being inserted into said concrete so that said third and fourth leg sections are buried in said concrete.

2. A bracket insert as claimed in claim 1 wherein the insert is formed from steel which is coated with a protective coating.

3. A bracket insert as claimed in claim 2 where the third leg formed in said metal sheet is provided with a series of apertures to permit the flow of concrete therethrough.

4. A bracket insert as claimed in claim 3 wherein the first leg sheet surface has pre-drilled holes for mounting other members thereto.

5. An anchor insert for a concrete wall formed from an elongated flat metallic sheet so as to form a plurality a sheet metal sections formed by bending the sheet along parallel lines extending lengthwise along the sheet, a first sheet section being flat and being joined to a second sheet section by an orthogonal bend, such that the first and second sections are of substantially the same width, a third sheet section joined at the opposite edge of the second sheet section by a second orthogonal bend, said third sheet section extending in a direction away from said first sheet section and being in a parallel plane to said first sheet section, and a fourth sheet section being a lip formed in edge of said sheet by an orthogonal bend in said third section, said third sheet section having substantially the same width as said first and second sheet sections.

6. An anchor insert as claimed in claim 5 wherein said lip folds backwardly toward said first sheet section.

7. An anchor insert as claimed in claim 6 wherein said third sheet section is provided with a series of spaced apertures slightly smaller than the width of said third sheet section.

8. An anchor insert as claimed in claim 7 wherein the first sheet section is provided with a series of spaced pre-drilled holes for attachment of other structural members.

9. An anchor insert as claimed in claim 8 wherein the sheet is a steel sheet covered with a protective coating.

* * * * *